US008602336B2

(12) United States Patent
Boliver et al.

(10) Patent No.: US 8,602,336 B2
(45) Date of Patent: Dec. 10, 2013

(54) CLAMPING APPARATUS FOR WOOD CHIPPER

(75) Inventors: Scott J. Boliver, Croghan, NY (US); Daniel McBride, Carthage, NY (US)

(73) Assignee: CEM Machine, Inc., Carthage, NY (US)

( * ) Notice: Subject to any disclaimer, the term of this patent is extended or adjusted under 35 U.S.C. 154(b) by 379 days.

(21) Appl. No.: 13/114,485

(22) Filed: May 24, 2011

(65) Prior Publication Data

US 2012/0298783 A1 Nov. 29, 2012

(51) Int. Cl.
*B02C 7/00* (2006.01)
*B02C 17/02* (2006.01)
*B27C 1/00* (2006.01)

(52) U.S. Cl.
USPC ..... 241/92; 241/296; 241/298; 144/176

(58) Field of Classification Search
USPC ..... 241/92, 294, 278.1, 296, 298; 144/176, 144/174, 220
See application file for complete search history.

(56) References Cited

U.S. PATENT DOCUMENTS 2,388,799 A 11/1945 Payzer et al.
4,669,516 A * 6/1987 Carpenter et al. ..... 144/241
4,784,337 A 11/1988 Nettles et al.
4,850,408 A 7/1989 Carpenter et al.
4,887,772 A * 12/1989 Robinson et al. ..... 241/92
4,977,939 A 12/1990 Depuy et al.
4,997,018 A * 3/1991 Carpenter et al. ..... 144/241
5,129,437 A * 7/1992 Nettles et al. ..... 144/176
5,139,063 A * 8/1992 Nettles et al. ..... 144/176
5,348,064 A 9/1994 Nettles et al.
5,660,218 A 8/1997 Jonkka
5,765,452 A * 6/1998 Roux et al. ..... 76/115
5,857,508 A * 1/1999 Jonkka ..... 144/363
6,484,770 B1 11/2002 Jonkka
6,976,516 B2 12/2005 Hale et al.
7,669,621 B2 * 3/2010 Nettles et al. ..... 144/176
7,896,268 B2 * 3/2011 Robinson et al. ..... 241/55
8,051,887 B2 * 11/2011 Robinson et al. ..... 144/373
2004/0060616 A1 4/2004 Jonkka et al.
2006/0174973 A1 8/2006 Jonkka
2008/0035242 A1 2/2008 Nettles et al.

* cited by examiner

*Primary Examiner* — Faye Francis
(74) *Attorney, Agent, or Firm* — Hiscock & Barclay, LLP

(57) ABSTRACT

A heavy duty rotary disc-type wood chipper containing a knife clamping system that conducts the impact and shearing loads acting upon the chipper knives along two primary axes which allows for more efficient dissipation of the impact loads and a reduction in the deleterious effects of off-axis loads resulting in the ability to use smaller holding bolts and smaller knives in the system without adversely effecting either the ability of the knives to stay fixed to the disc or the quality of chips produced.

10 Claims, 6 Drawing Sheets

CLAMPING APPARATUS FOR WOOD CHIPPER

FIELD OF THE INVENTION

This invention relates to a wood chipper and, more specifically, to a heavy duty rotary disc wood chipper, however this same concept can also be applied to clamping of knives mounted in drum chippers.

BACKGROUND OF THE INVENTION

Heavy duty wood chippers that are capable of producing large amounts of chips in a relatively short period of time typically employ a circular disc that is mounted for rotation upon a horizontally disposed drive shaft. A plurality of rectangular knives are radially extended upon the front face of the disc. Each knife is, in turn, aligned adjacent to a chip slots that passes through the disc between its front face and back face. Logs or similar work pieces are brought into contact with the front face of the rotating disc within a stationary work station where the moving knives act in association with a stationary bed knife to remove chips from the work pieces. The chips are conducted through the chip slots and exhausted from the machine.

The knives that are typically used in these heavy duty machines are subjected to high impact loads which, if not effectively resisted can adversely affect the life of the knives and quality of the product produced in the machine depending upon various loading factors. In an effort to combat these high loads, it has been customary in the industry to use knives that are relatively massive in not only size but also in weight. As a result, the apparatus for securing the knives within a chipper is generally rather complex and expensive to build and maintain. Removal of the knives from the machine for refurbishing or replacing is usually a time consuming procedure. In addition, handling the massive knives is a multi-worker task and can pose a danger to the workers and the knives if the knives are mishandled or dropped. Systems employing much smaller knives meanwhile typically compromise the strength of the knives and the holding system resulting in a weaker overall clamping and holding system.

Good knife support systems must also accommodate normal variations in thickness of knives due to variability in knife manufacture tolerances and also to accommodate for contamination such as wood dust, tree sap and debris that might work itself between mated parts while still safely and adequately holding the knives in place.

The apparatus used to secure a chipper knife to a disc most generally involves some type of clamping mechanism for releasably capturing the knife or knives between the clamp and a substrate on the disc. The clamping force is typically provided by bolts that pass through the clamp and are threaded into the substrate so that the axes of the bolt shanks are generally normal to the front face of the disc. When used with hardware that permits keyed or doweled contact and transmission of forces to the disc, this type of clamping arrangement is well suited to resist input loads acting parallel to or perpendicular with the axis of the bolts. The clamping arrangement, however, is not as well suited to resist loads other than those running along these two primary axes or to couples arising from loads not being applied concentrically with the disc key supports or the holding bolts. These off-axis loads and couples are generally concentrated along one edge section of the bolt heads, a condition referred to as "point loading" of the bolt head, which results in a reduction in the holding effectiveness of the clamp and clamping bolts. When point loading occurs, the bolts or knife clamps can fatigue and fail giving rise to an unsafe situation of inadequately clamped knives and knives rapidly become dull or damaged and the quality of the chips produced being greatly reduced. Gaps and clearances that are often present between clamping system components can permit parts to deflect from their stress-free manufactured states, further exacerbating the "point loading" problem referred to above and observed in practice.

SUMMARY OF THE INVENTION

It is therefore a primary object of the present invention to improve heavy duty rotary disc wood chippers.

It is a further object of the present invention to improve the apparatus for supporting chipper knives in a rotary disc chipper.

It is a still further object of the present invention to reduce the size and weight of the knives used in rotary disc chippers without sacrificing the strength of the holding system and efficiency of the machine or the quality of product produced.

Another object of the present invention is to reduce the amount of time and effort needed to remove, refurbish and replace knives in a rotary disc chipper.

Still another object of the present invention is to reduce the deleterious effects of off-axis loads and couples on the knives and knife clamping system of a heavy duty rotary chipper.

A still further object of the present invention is to provide a knife clamping system that is largely uncompromised by normal variations in thickness of knives and contamination therein between clamped or coupled parts.

These and other objects of the invention are attained in a heavy duty rotary disc chipper by a knife hold down system that concentrates the loads acting upon the knives along two primary axes that are either parallel with or perpendicular to the front face of the disc such that the impact loads on the system are more effectively resisted and the deleterious effects of off axis loads greatly reduced. This, in turn allows for the use of smaller knives in the system without adversely effecting the efficiency of the system or the quality of the product produced.

BRIEF DESCRIPTION OF THE DRAWINGS

For a better understanding of these and other objects of the invention, reference shall be made to the following detailed description of the invention which should be read in conjunction with the accompanying drawings wherein.

DETAILED DESCRIPTION OF THE INVENTION

Figure 1:
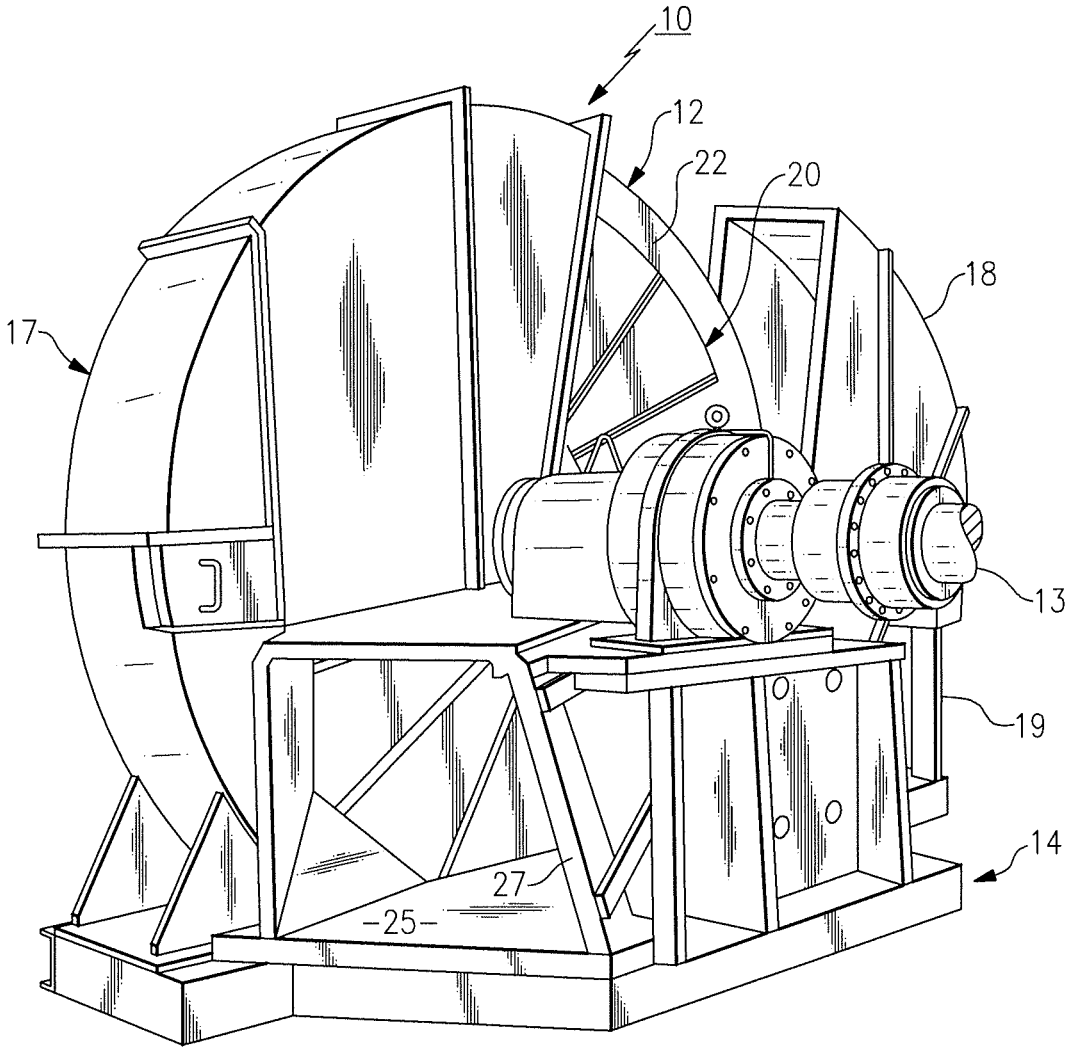
FIG. 1 is a perspective view of a heavy duty rotary disc chipper embodying the teachings of the invention.

Referring initially to FIG. 1, there is illustrated a front perspective view of a heavy duty rotary disc wood chipper, generally referenced 10, that embodies the teachings of the present invention. The chipper is of a well known Heavy Duty design that includes a vertically disposed disc 12 that is mounted for rotation upon a horizontal drive shaft 13. The shaft is supported in bearing blocks that are mounted upon a stationary frame 14 along with a drive motor (not shown).

The disc 12 is enclosed within a protective housing, generally referenced 17, made up of a number of separtable sections. One of the sections 18 is shown moved back along a rail system 19 to permit clear access to the disc. A number of triangular shaped knife holders 20, sometimes referred to as segments, are secured to the front face of the disc. As will be described in greater detail below, each knife holder supports one or more chipper knives which are drawn through a stationary chipping station 25 as the disc rotates about the drive shaft 13. In the chipping station, the knives co-act with a stationary bedknife to remove chips from wooden work pieces, typically logs, that are brought into contact with the front face of the disc. In this particular embodiment, the work pieces are brought by a conveyor (not shown) into contact with the disc through a horizontal delivery spout 27 that is integral with the support frame 14. Although a horizontal feed station is intended for use in the illustrated machine, a vertical gravity feed system may be similarly utilized without departing from the teachings of the present invention.

Figure 2:
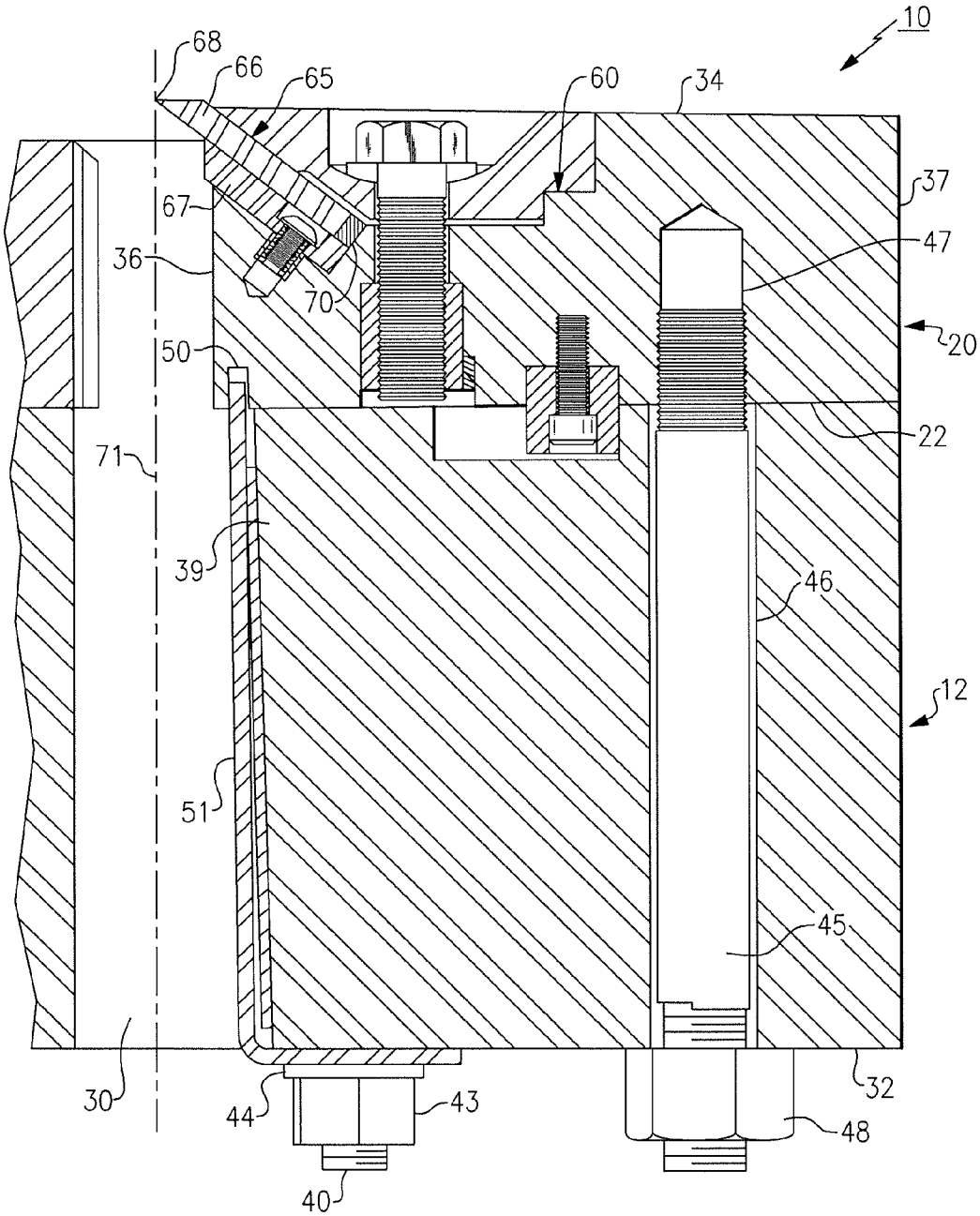
FIG. 2 is an enlarged partial sectional view taken through the disc further illustrating a portion of the disc and one of a plurality of segmented knife holder that are mounted upon the front face of the disc.
Figure 3:
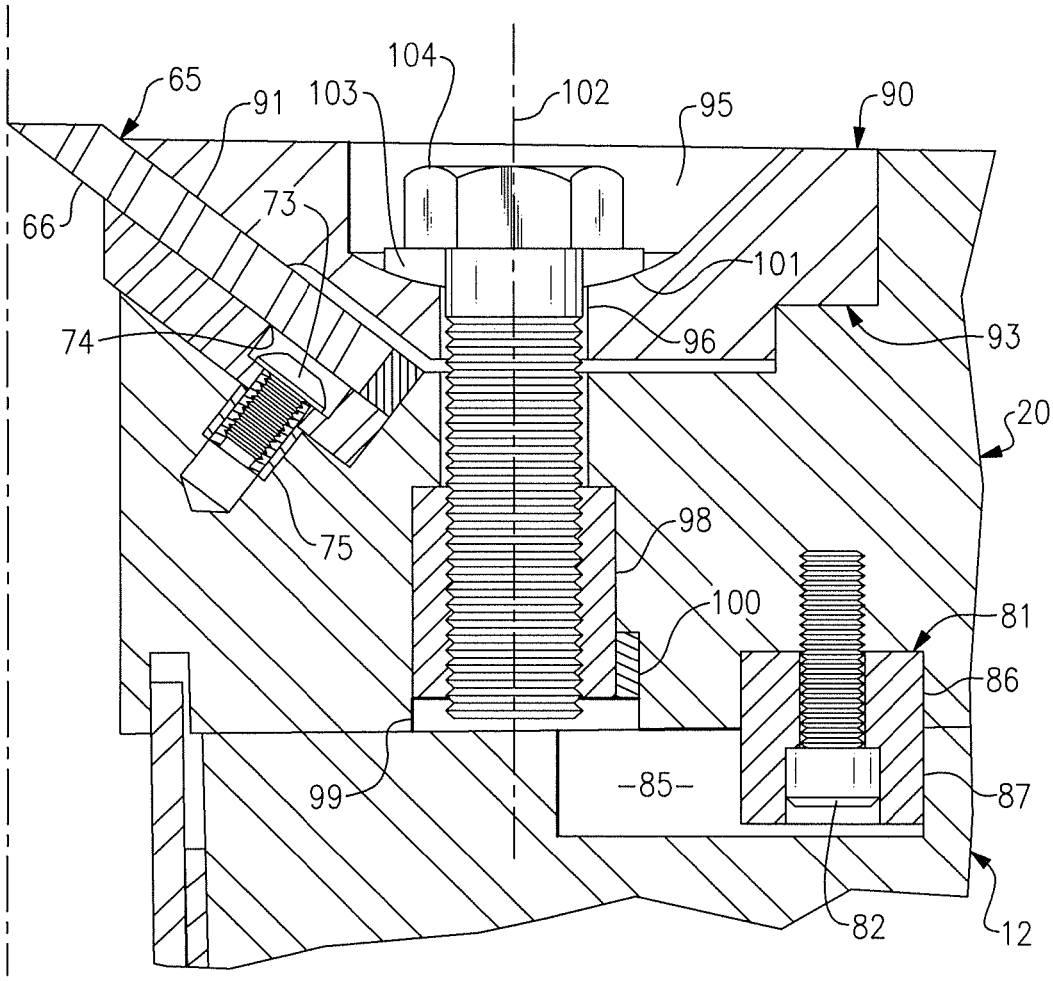
FIG. 3 is a partial enlarged sectional view similar to FIG. 2 illustrating the segmented knife holder in greater detail.
Figure 4:
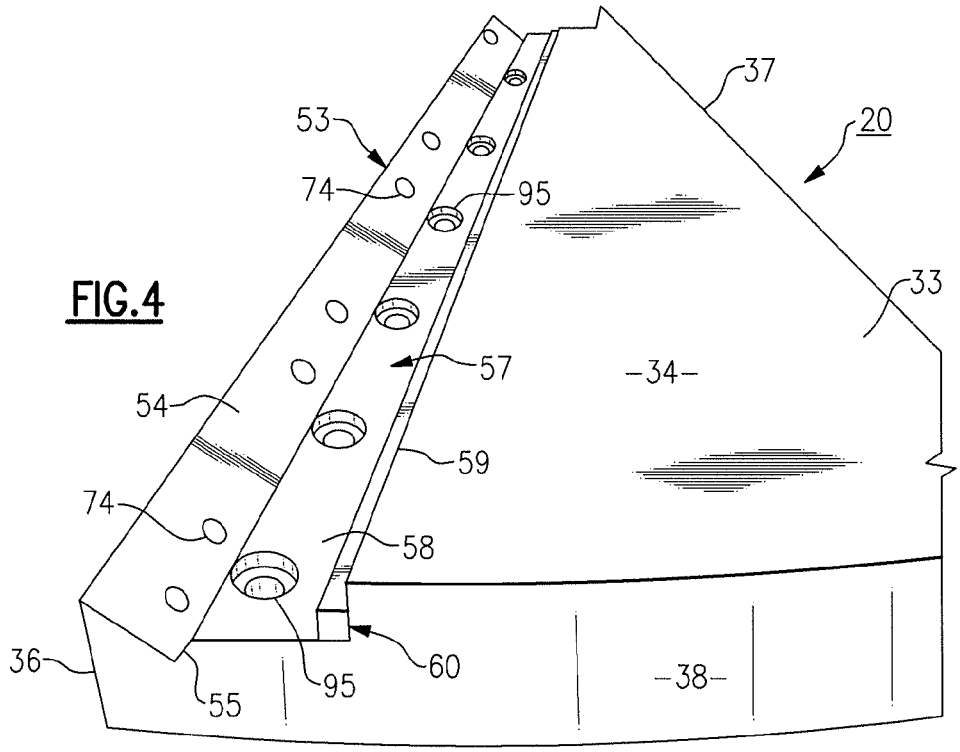
FIG. 4 is a top perspective view of the body of the knife holder shown in FIGS. 2 and 3.
Figure 5:
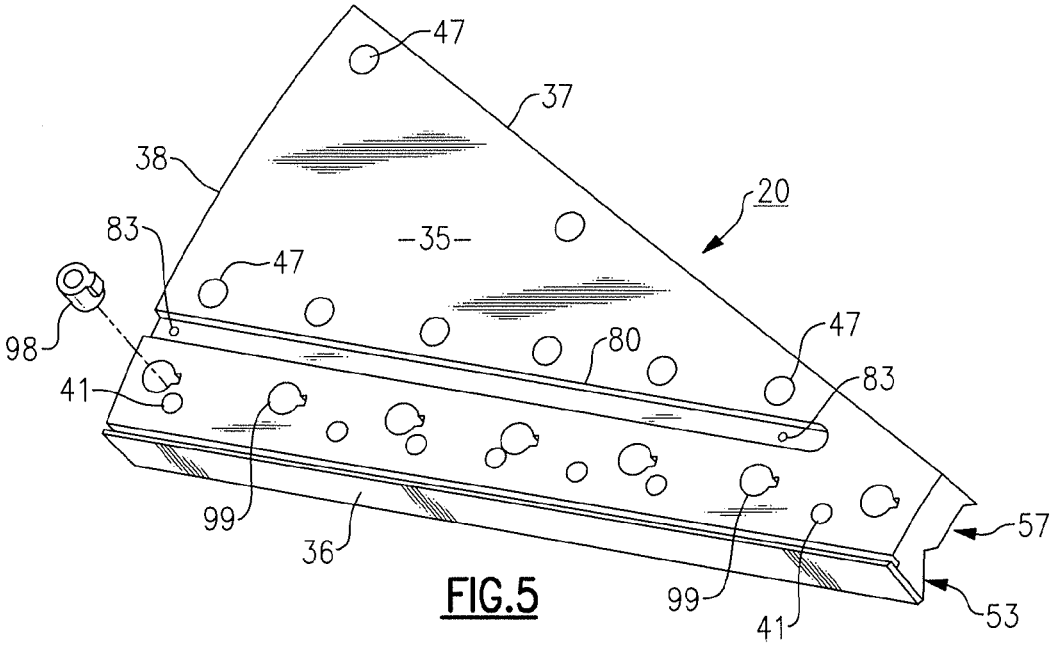
FIG. 5 is a bottom perspective view of the knife holder body shown in FIG. 4.
Figure 6:
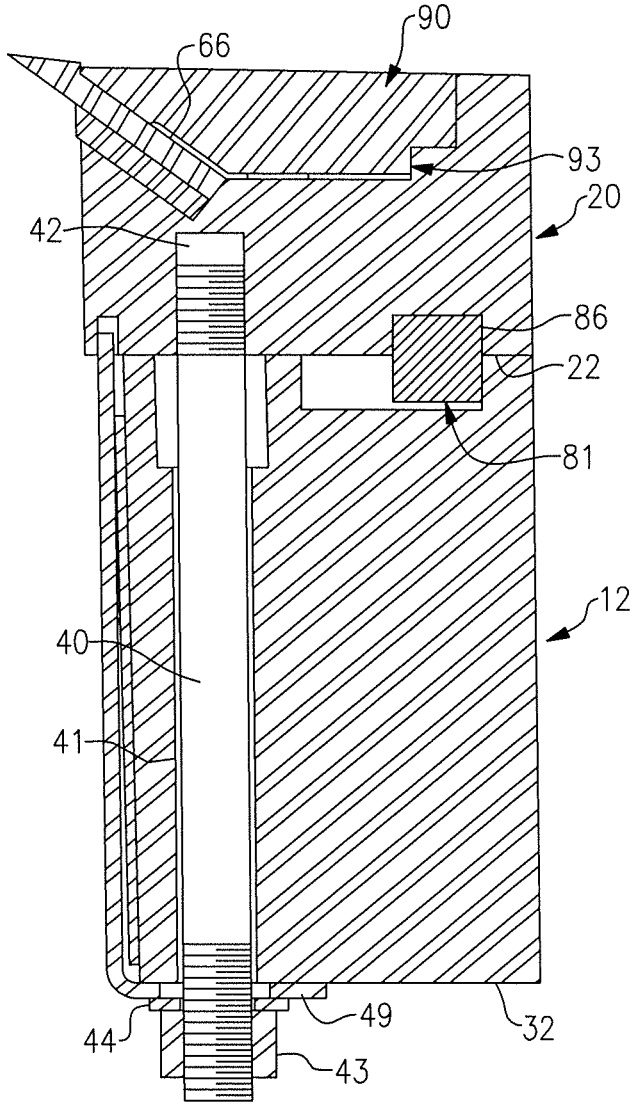
FIG. 6 is an enlarged partial sectional view taken through another part of the knife holder illustrated in FIG. 1.

Turning now more specifically to FIGS. 2-7, the common structural arrangement of the individual knife holders 20 will be described in greater detail. The number of knife holders that are spaced about the disc may vary depending upon the size of the disc and production required from the disc chipper. Each holder is mounted upon the disc face adjacent to a chip slot 30 that extends more or less radially along the disc and passes through the disc between its front face 22 and its back face 32 (FIG. 2). As best illustrated in FIGS. 4 and 5 each knife holder has a triangular shaped solid one piece body 20 that includes a top wall surface 34 that can be planar or flat and a nominally parallely aligned bottom wall surface 35. The top and bottom wall surfaces are co joined by a pair of linear side wall surfaces 36 and 37 and an arcuate shaped base wall surface 38 that compliments the outer edge of the disc. In assembly the bottom wall surface of the holder body is seated upon the flat front face 22 of the disc and is secured to the disc by a plurality of studs that are passed through the disc by means of suitable clearance holes. In assembly, side wall surface 36 of the knife holder runs more or less radially along the edge 39 of the adjacent chip slot 30.

The studs securing each knife holder body to the disc include a row of smaller diameter studs 40 (FIG. 6) that are mounted within clearance holes 41 that run adjacent to the chip slot. Both ends of the studs 40 contain a male thread with one end being threaded into threaded holes 42 located in the bottom of the knife holder body. A nut 43 is threaded upon the opposite end of each stud that acts against a washer 44. Larger diameter studs 45 (FIG. 2) are similarly contained within clearance holes 46 located in the disc. One end of each large diameter studs is threaded into a threaded hole 47 formed in the knife holder while the opposite end of each stud is mated with a nut 48. Torquing down nuts 43 and 48 tightly secures the bottom wall surface of the knife holder against the front face of the disc.

When the knife holder is secured in place its side wall surface 36 runs radially along one edge of the adjacent chip slot 30 and protrudes slightly into the slot. A cutout 50 is provided in the protrusion and one end of a wear plate 51 is supported in the cutout. The wear plate passes out of the cutout along the wall 39 of the slot and turns at a right angle along the rear face 32 of the disc. The angled section 49 of the wear plate is provided with a series of clearance holes that allow this section of the wear plate to be placed over the studs 40 into contact against the rear face 32. Torquing down the stud nuts 43 secures the wear plate in place within the chip slot and helps to secure the knife holder in place with the bottom wall surface in parallel alignment with the front face of the disc.

Figure 7:
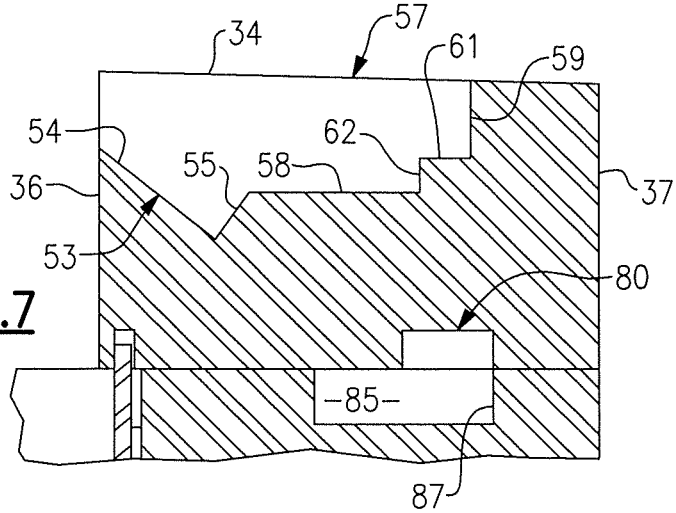
FIG. 7 is an enlarged partial sectional view taken through yet another part of the knife holder with the clamping mechanism removed from the body of the knife holder.

Turning now more specifically to FIGS. 4 and 5, each knife holder 20 contains a V-shaped knife seat generally references 53 (FIG. 7) that runs along the side wall surface 36 of the holder. The seat includes an inclined wall surface 54 that passes upwardly and opens through the side wall surface 36 of the holder and a back wall 55 that is perpendicularly aligned with the inclined wall 54. A rectangular shaped compartment 57 for housing a knife clamping mechanism is recessed in the top wall surface 34 of the knife holder body. The compartment includes a flat floor 58 that runs parallel with the bottom wall surface 34 of the holder and which opens into the knife seat through the rear wall 55 of the seat. The compartment further includes an upwardly extended back wall 59 that is substantially perpendicular to the top and bottom wall surfaces of the knife holder. A raised pedestal 60 (FIG. 2) extends along the back wall of the compartment and has a flat top surface 61 and flat front surface 62 (FIG. 7). The top surface of the pedestal is parallel with the top and bottom wall surfaces of the knife holder while the front surface of the pedestal is substantially perpendicular to the top and bottom surfaces of the knife holder.

A knife assembly 65 is shown mounted within the knife seat 53 in FIGS. 2 and 3. The assembly includes an upper chipper knife 66 and a lower counter knife 67 that is mounted between the chipper knife and the inclined wall 54 of the knife seat 53. Although a dual knife assembly is included in the description of the present invention, it should be clear from the description below that the counter knife can be eliminated from the knife assembly without departing from the teachings of the present invention. The chipper knife is of a conventional design having a rectangular body with a cutting blade 68 running laterally along a top corner edge of the knife body. The lower edge of the knife is provided with an adjusting spacer 70 which in this case is a series of babbit (cast metal) inserts that are spaced apart along the radial length of the knife body. A series of adjustable screws or wedges can be similarly employed. The spacer acts between the lower edge of the knife and the back wall 55 of the knife seat to position the tip of the blade slightly above the top wall surface 34 of the knife holder on about the axial centerline 71 of the chip slot. The back surface of the counter knife rests directly upon the rear wall of the knife seat to position the blade of the counter knife inside the chip slot in a position to act upon the chips leaving the chipper blade. As best shown in FIG. 3, the counter knife is secured to the knife holder body by a series of set screws 73 that are housed within countersunk bores 74 (FIG. 3) within the body of the counter knife. The screws may be mated with threaded inserts 75 that are embedded within the body of holder.

A keyway 80 (FIG. 7) is formed in the bottom wall surface 35 of the knife holder that runs parallel with the side wall surface 36 of the holder. A key 81 having a rectangular cross section area is mounted in the keyway and secured therein by a pair of set screws 82 that are threaded into holes 83 (FIG. 5) formed in the base of the keyway. In assembly, the lower portion of the key is received within an expanded recess 85 contained within the disc with the sidewall 86 of the key in contact with the sidewall 87 of the expanded recess. The key can also be made as an integral part of the knife holder body.

As best illustrated in FIG. 3, an elongated clamp 90 is enclosed within the clamp compartment 57 of the knife holder body. The clamp extends along the radial length of the compartment and contains a first contact area 91 that rests in abutting contact with the upper surface of the chipper knife or knives mounted in the knife seat. The opposite side of the clamp contains a right angle contact area 93 that compliments the top wall 61 (FIG. 7) and front wall 62 of the raised pedestal 60 which runs along the rear wall of the compartment. The bottom wall of the contact area 93 which is parallel with the bottom wall surface 35 of the knife holder abuts against the top surface 61 of the pedestal while the side wall of the cutout which is perpendicular to the bottom wall surface of the knife holder abuts the front wall 62 of the pedestal. Accordingly a tight right angle joint is established between the clamp and the knife holder body which resists input loads acting either parallel to or perpendicular with the knife holder body.

A number of recessed openings 95 are provided in the top surface of the clamp that are spaced apart along its radial length. Each opening contains a clearance hole 96 that allows a clamping bolt 104 to pass through the clamp. The bolt is mated with a threaded insert 98 contained within a receiving bore 99 formed within the knife holder body. Each insert contains an anti-rotation key 100 that prevents the insert from turning in the bore as the bolt is torqued down in assembly. This insert can also be made an integral component of the knife holder.

The bottom surface of each bolt receiving opening is provided with a concave spherical seat 101 that is centered upon the axial centerline 102 of the clearance hole 96. A spherical washer 103 is placed under the head of each bolt that has a convex spherical lower surface that compliments the shape of the seat 101 and which establishes a spherical joint between the bolt head 104 and the clamp when the bolts are torqued down. The spherical joint that is established between the bolt and the knife holder body serves to concentrate off-axis impact loads generating during the chipping process along the axis of the clamping bolts thereby considerably reducing the otherwise deleterious effects of unwanted off axis loads or couples. The spherical seat in the holder body can be replaced with a flat seat perpendicular to the axes of the bolt holes and separate washers with complimentary arcuate shaped mating surfaces to provide a spherical joint without departing from the teaching of the present invention.

Due to the present system ability to direct all impact loads acting upon the system along two primary axes, the overall loading upon the system is more effectively resisted and the size of the knives used in the chipper can be considerably reduced. This, in turn, allows for greater ease in handling of the knives when loading, refurbishing and reloading the knives. Tasks that normally had to be carried out by more than one person can now be carried out rapidly and safely by a single worker. In addition, test have shown that multiple smaller than normal chipping knives can be safely mounted in a side by side relationship within each knife holder seat thereby further reducing handling problems typically associated with larger more massive knives.

Figure 8:
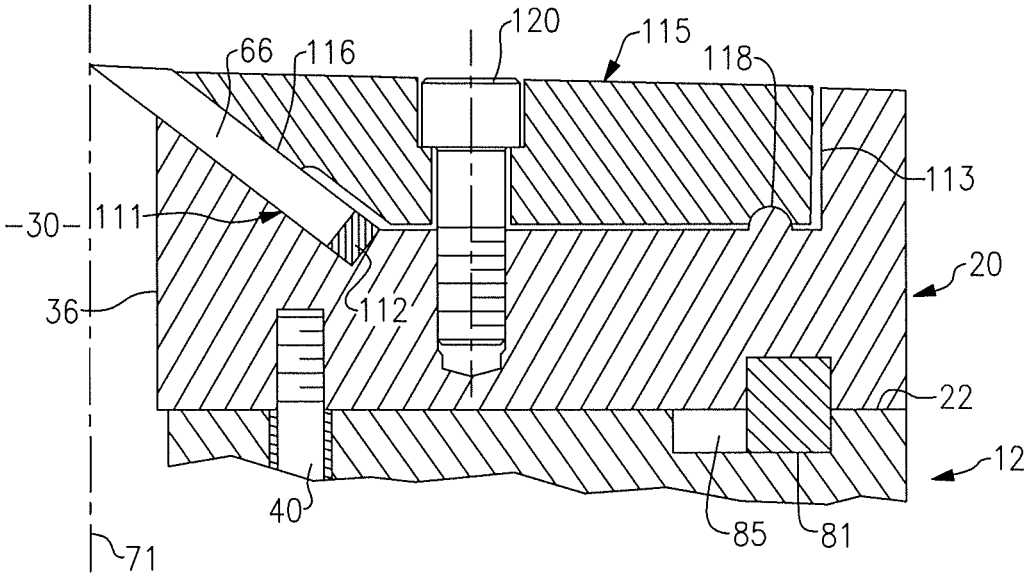
FIG. 8 is a partial sectional view showing a further embodiment of the invention.

FIG. 8 illustrates a further embodiment of the present invention. Here again, the knife holder body 20 contains a bottom wall surface 35 that is parallel with the front face 22 of the rotary disc 12 of the chipping machine. As explained in detail above the holder body is generally triangular shaped and has one side wall 36 running radially along one side wall 39 of an adjacent chip slot 30. In this embodiment, one or more chipper knives 66 are mounted within a knife seat 111 with a suitable adjustable spacer 112 for positioning the cutting edge of the knife or knives on about the central axis of the chip slot.

Here again the knife holder body contains a recessed clamp compartment 113 that opens into the knife seat through the back wall of the seat. A radially extended clamp 115 is mounted inside the compartment and includes a contact area 116 that rests in abutting contact with the top surface of the knife or knives located within the knife seat. A convex spherical shaped raised key 118 extends radially along the floor of the compartment and is arranged to mate with a complimentary concave keyway that is formed in the bottom wall of the clamp to support the clamp above the floor of the compartment. A series of cylindrical headed screws 120 are passed through clearance holes formed in the clamp between the contact area 116 and the key 118 and are threaded into the body of the knife holder to support the clamp within the body of the knife holder.

A rectangular shaped key 81 is mounted within a keyway that runs radially along the length of the holder body. The side walls of the key are perpendicular aligned with the bottom wall of knife holder while the top and bottom walls of the key are parallely aligned with the top and bottom walls of the holder. The key extends beyond the bottom wall of the knife holder and the extended portion of the key is received within an expanded keyway 85 formed in the front face of the disc. At least one side wall of the key is in abutting contact with one side wall of the expanded keyway 85 so as to resist loads that are generated on the system that act along the two primary load axes which, as explained above, run parallel with or perpendicular to the face of the disc. The spherical joint between the clamp and the knife holder body established by the spherical key serves to concentrate off-axis input loads generated during the chipping process along one of the primary load axes thereby reducing the otherwise deleterious effects of these otherwise harmful loads. The knife body is tightly secured against the front face of the disc by a series of studs such as stud 40.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A wood chipper that contains a rotatable disc having a vertically aligned front and rear faces with at least one radially extended chip slot that passes through said disc and wherein said chipper includes:

a knife holder having a body with a top wall surface, a flat bottom wall surface and at least one side wall surface that is generally perpendicular to said bottom wall surface;

means for securing said bottom wall surface of said knife holder body against the front face of said disc with said one side wall surface running radially along an adjacent edge of said chip slot;

a chipper knife mounted within a knife seat contained within said knife holder body;

a clamp having a contact area located at one end that abuts against said chipper knife;

a connector extending between said clamp and said knife holder body that contains a spherical joint; and a series of threaded fasteners that pass through clearance holes located within said clamp and are threaded into said knife holder such that when said threaded fasteners are torque down loads acting upon said chipper knife along axes other than those that are perpendicular to or parallel with the bottom wall surface of said knife holder are concentrated along the axes of said threaded fasteners.

2. The wood chipper of claim 1 that further includes a rectangular key for connecting the knife holder body and the front face of said disc, said key having side walls that are generally perpendicular to the bottom wall surface of said knife holder body.

3. The wood chipper of claim 1 wherein said threaded fasteners have axes that are perpendicular to the bottom wall surface of said knife holder body.

4. A wood chipper that contains a rotatable disc having flat vertically aligned front and rear faces and at least one radially extended chip slot that passes through said disc between the two disc faces, wherein said chipper also includes:

a knife holder having a body with a top wall surface, a flat bottom wall surface and at least one side wall surface that is generally perpendicular to said bottom wall surface;

fastener means for securing said bottom wall surface of said knife holder against the front face of said disc and said at least one of said side wall surface running radially along an adjacent edge of said chip slot;

a V-shaped knife seat running along said one side wall surface of said knife holder, said knife seat having an inclined bottom wall that opens through said one side wall surface into said chip slot and a back wall that is perpendicular to said inclined bottom wall;

a compartment recessed in said top wall surface of said knife holder having a planar floor that is parallel with said bottom wall surface of said knife holder and which opens through said back wall of said knife seat, and a rear wall that is perpendicular to said flat disc mounting surface and floor;

at least one chipper knife mounted within said knife seat with a proximal end of the knife in contact with said back wall of said knife seat and distal end of the knife positioned within said chip slot entrance;

a raised pedestal that runs along the length of the rear wall of said compartment and contains a top surface that is parallel to the flat bottom wall surface of the knife holder body and a front surface that is perpendicular to said flat bottom wall surface of said knife holder body;

a clamp enclosed within said compartment having a first contact area abutting said knife and a second contact area abutting said top surface and said front surface of said pedestal;

a series of clamping bolts each having a threaded shank that passes through a clearance hole in said clamp and being threaded into said knife holder so that the axis of said bolts are perpendicular to the flat bottom wall surface of the knife holder body; and a circular connector encircling said shank of each clamping bolt having an upper surface for evenly abutting the head of said bolt and a convex lower surface that mates evenly with a concave spherical seat located in said knife holder that surrounds said clearance hole, such that when said bolts are torqued down in assembly off-axis impact loads and wood shearing loads acting upon said chipper knife are withstood by either the raised pedestal in the knife holder or are concentrated along the axes of said bolts.

5. The wood chipper of claim 4 wherein a keyway is located in the bottom wall of surface of said knife holder body that extends along the radial length of said knife holder and an integral or separate key secured in said keyway that mates with a second keyway located in knife holder mounting face of said disc.

6. The wood chipper of claim 4 wherein said clamping bolts are mated with tapped holes or threaded inserts contained in said knife holder.

7. The wood chipper of claim 4 wherein at least one or more knives are mounted in an end to end relation within said knife seat.

8. The wood chipper of claim 4 that further includes a counterknife mounted in said knife seat between said chipper knife and said inclined bottom wall of said knife seat.

9. The wood chipper of claim 4 that further includes one or more spacers mounted between the chipper knife and the back wall of said knife seat.

10. The wood chipper of claim 9 wherein one or more spacers are adjustable in width such as screws tapped into holes of knives or babbit that is cast against the knife.

* * * * *